US010665253B2

(12) United States Patent
Wein

(10) Patent No.: US 10,665,253 B2
(45) Date of Patent: May 26, 2020

(54) VOICE ACTIVITY DETECTION USING A SOFT DECISION MECHANISM

(71) Applicant: Verint Systems Ltd., Herzliya Pituach (IL)

(72) Inventor: Ron Wein, Ramat Hasharon (IL)

(73) Assignee: VERINT SYSTEMS LTD., Herzilya, Pituach (IL)

( * ) Notice: Subject to any disclaimer, the term of this patent is extended or adjusted under 35 U.S.C. 154(b) by 26 days.

(21) Appl. No.: 15/959,743

(22) Filed: Apr. 23, 2018

(65) Prior Publication Data

US 2018/0374500 A1 Dec. 27, 2018

Related U.S. Application Data

(63) Continuation of application No. 14/449,770, filed on Aug. 1, 2014, now Pat. No. 9,984,706.

(60) Provisional application No. 61/861,178, filed on Aug. 1, 2013.

(51) Int. Cl.
*G10L 11/06* (2006.01)
*G10L 25/78* (2013.01)

(52) U.S. Cl.
CPC ..... *G10L 25/78* (2013.01)

(58) Field of Classification Search
CPC ..... G10L 25/78; G10L 25/93; G10L 21/02; G10L 25/84; G10L 25/18; G10L 2025/932; G10L 2025/937; G10L 21/0364; G10L 25/87; G10L 15/01; G10L 15/04; G10L 15/08; G10L 25/51; G10L 25/60; G10L 25/81; G10L 17/00; G10L 17/005; G10L 17/02; G10L 17/04; G10L 17/06; G10L 2025/783; G10L 21/0216; G10L 25/27; G10L 25/48; G10L 15/10; G10L 15/1815;
(Continued)

(56) References Cited

U.S. PATENT DOCUMENTS 4,653,097 A 3/1987 Watanabe et al.
4,864,566 A 9/1989 Chauveau
5,027,407 A 6/1991 Tsunoda
(Continued)

FOREIGN PATENT DOCUMENTS

EP 0598469 5/1994
JP 2004/193942 7/2004
(Continued)

OTHER PUBLICATIONS

Baum, L.E., et al., "A Maximization Technique Occurring in the Statistical Analysis of Probabilistic Functions of Markov Chains," The Annals of Mathematical Statistics, vol. 41, No. 1, 1970, pp. 164-171.
(Continued)

*Primary Examiner* — Huyen X Vo
(74) *Attorney, Agent, or Firm* — Meunier Carlin & Curfman LLC

(57) ABSTRACT

Voice activity detection (VAD) is an enabling technology for a variety of speech based applications. Herein disclosed is a robust VAD algorithm that is also language independent. Rather than classifying short segments of the audio as either "speech" or "silence", the VAD as disclosed herein employees a soft-decision mechanism. The VAD outputs a speech-presence probability, which is based on a variety of characteristics.

22 Claims, 3 Drawing Sheets

(58) Field of Classification Search
CPC ..... G10L 2015/088; G10L 2015/223; G10L 25/00
See application file for complete search history.

(56) References Cited

U.S. PATENT DOCUMENTS 5,222,147 A 6/1993 Koyama
5,638,430 A 6/1997 Hogan et al.
5,805,674 A 9/1998 Anderson
5,907,602 A 5/1999 Peel et al.
5,946,654 A 8/1999 Newman et al.
5,963,908 A 10/1999 Chadha
5,999,525 A 12/1999 Krishnaswamy et al.
6,044,382 A 3/2000 Martino
6,145,083 A 11/2000 Shaffer et al.
6,266,640 B1 7/2001 Fromm
6,275,806 B1 8/2001 Pertrushin
6,427,137 B2 7/2002 Petrushin
6,480,825 B1 11/2002 Sharma et al.
6,510,415 B1 1/2003 Talmor et al.
6,587,552 B1 7/2003 Zimmerman
6,597,775 B2 7/2003 Lawyer et al.
6,915,259 B2 7/2005 Rigazio
7,006,605 B1 2/2006 Morganstein et al.
7,039,951 B1 5/2006 Chaudhari et al.
7,054,811 B2 5/2006 Barzilay
7,106,843 B1 9/2006 Gainsboro et al.
7,158,622 B2 1/2007 Lawyer et al.
7,212,613 B2 5/2007 Kim et al.
7,299,177 B2 11/2007 Broman et al.
7,386,105 B2 6/2008 Wasserblat et al.
7,403,922 B1 7/2008 Lewis et al.
7,539,290 B2 5/2009 Ortel
7,657,431 B2 2/2010 Hayakawa
7,660,715 B1 2/2010 Thambiratnam
7,668,769 B2 2/2010 Baker et al.
7,693,965 B2 4/2010 Rhoads
7,778,832 B2 8/2010 Broman et al.
7,822,605 B2 10/2010 Zigel et al.
7,908,645 B2 3/2011 Varghese et al.
7,940,897 B2 5/2011 Khor et al.
8,036,892 B2 10/2011 Broman et al.
8,073,691 B2 12/2011 Rajakumar
8,112,278 B2 2/2012 Burke
8,311,826 B2 11/2012 Rajakumar
8,510,215 B2 8/2013 Gutierrez
8,537,978 B2 9/2013 Jaiswal et al.
8,554,562 B2 10/2013 Aronowitz
8,913,103 B1 12/2014 Sargin et al.
9,001,976 B2 4/2015 Arrowood
9,237,232 B1 1/2016 Williams et al.
9,368,116 B2 6/2016 Ziv et al.
9,558,749 B1 1/2017 Secker-Walker et al.
9,584,946 B1 2/2017 Lyren et al.
2001/0026632 A1 10/2001 Tamai
2002/0022474 A1 2/2002 Blom et al.
2002/0099649 A1 7/2002 Lee et al.
2003/0050780 A1 3/2003 Rigazio
2003/0050816 A1 3/2003 Givens et al.
2003/0097593 A1 5/2003 Sawa et al.
2003/0147516 A1 8/2003 Lawyer et al.
2003/0208684 A1 11/2003 Camacho et al.
2004/0029087 A1 2/2004 White
2004/0111305 A1 6/2004 Gavan et al.
2004/0131160 A1 7/2004 Mardirossian
2004/0143635 A1 7/2004 Galea
2004/0167964 A1 8/2004 Rounthwaite et al.
2004/0203575 A1 10/2004 Chin et al.
2004/0225501 A1 11/2004 Cutaia
2004/0240631 A1 12/2004 Broman et al.
2005/0010411 A1 1/2005 Rigazio
2005/0043014 A1 2/2005 Hodge
2005/0076084 A1 4/2005 Loughmiller et al.
2005/0125226 A1 6/2005 Magee
2005/0125339 A1 6/2005 Tidwell et al.
2005/0185779 A1 8/2005 Toms
2006/0013372 A1 1/2006 Russell
2006/0106605 A1 5/2006 Saunders et al.
2006/0111904 A1 5/2006 Wasserblat et al.
2006/0149558 A1 7/2006 Kahn
2006/0161435 A1 7/2006 Atef et al.
2006/0212407 A1 9/2006 Lyon
2006/0212925 A1 9/2006 Shull et al.
2006/0248019 A1 11/2006 Rajakumar
2006/0251226 A1 11/2006 Hogan et al.
2006/0282660 A1 12/2006 Varghese et al.
2006/0285665 A1 12/2006 Wasserblat et al.
2006/0289622 A1 12/2006 Khor et al.
2006/0293891 A1 12/2006 Pathuel
2007/0041517 A1 2/2007 Clarke et al.
2007/0071206 A1 3/2007 Gainsboro et al.
2007/0074021 A1 3/2007 Smithies et al.
2007/0100608 A1 5/2007 Gable et al.
2007/0124246 A1 5/2007 Lawyer et al.
2007/0244702 A1 10/2007 Kahn et al.
2007/0280436 A1 12/2007 Rajakumar
2007/0282605 A1 12/2007 Rajakumar
2007/0288242 A1 12/2007 Spengler
2008/0010066 A1 1/2008 Broman et al.
2008/0181417 A1 7/2008 Pereg et al.
2008/0195387 A1 8/2008 Zigel et al.
2008/0222734 A1 9/2008 Redlich et al.
2008/0312914 A1* 12/2008 Rajendran ..... G10L 19/022 704/207
2009/0046841 A1 2/2009 Hodge
2009/0119103 A1 5/2009 Gerl et al.
2009/0119106 A1 5/2009 Rajakumar
2009/0147939 A1 6/2009 Morganstein et al.
2009/0247131 A1 10/2009 Champion et al.
2009/0254971 A1 10/2009 Herz et al.
2009/0319269 A1 12/2009 Aronowitz
2010/0228656 A1 9/2010 Wasserblat et al.
2010/0303211 A1 12/2010 Hartig
2010/0305946 A1 12/2010 Gutierrez
2010/0305960 A1 12/2010 Gutierrez
2011/0026689 A1 2/2011 Metz et al.
2011/0119060 A1 5/2011 Aronowitz
2011/0191106 A1 8/2011 Khor et al.
2011/0202340 A1 8/2011 Ariyaeeinia et al.
2011/0213615 A1 9/2011 Summerfield et al.
2011/0251843 A1 10/2011 Aronowitz
2011/0255676 A1 10/2011 Marchand et al.
2011/0282661 A1 11/2011 Dobry et al.
2011/0282778 A1 11/2011 Wright et al.
2011/0320484 A1 12/2011 Smithies et al.
2012/0053939 A9 3/2012 Gutierrez et al.
2012/0054202 A1 3/2012 Rajakumar
2012/0072453 A1 3/2012 Guerra et al.
2012/0232896 A1* 9/2012 Taleb ..... G10L 25/78 704/233
2012/0253805 A1 10/2012 Rajakumar et al.
2012/0254243 A1 10/2012 Zeppenfeld et al.
2012/0263285 A1 10/2012 Rajakumar et al.
2012/0265526 A1* 10/2012 Yeldener ..... G10L 25/84 704/233
2012/0284026 A1 11/2012 Cardillo et al.
2013/0163737 A1 6/2013 Dement et al.
2013/0197912 A1 8/2013 Hayakawa et al.
2013/0253919 A1 9/2013 Gutierrez et al.
2013/0253930 A1 9/2013 Seltzer et al.
2013/0300939 A1 11/2013 Chou et al.
2014/0067394 A1 3/2014 Abuzeina
2014/0074467 A1 3/2014 Ziv et al.
2014/0074471 A1 3/2014 Sankar et al.
2014/0142940 A1 5/2014 Ziv et al.
2014/0142944 A1 5/2014 Ziv et al.
2015/0025887 A1 1/2015 Sidi et al.
2015/0055763 A1 2/2015 Guerra et al.
2015/0249664 A1 9/2015 Talhami et al.

(56) References Cited

U.S. PATENT DOCUMENTS

| | | | |
|---|---|---|---|
| 2016/0217793 | A1 | 7/2016 | Gorodetski et al. |
| 2017/0140761 | A1 | 5/2017 | Secker-Walker et al. |

FOREIGN PATENT DOCUMENTS

| | | |
|---|---|---|
| JP | 2006/038955 | 9/2006 |
| WO | 2000/077772 | 12/2000 |
| WO | 2004/079501 | 9/2004 |
| WO | 2006/013555 | 2/2006 |
| WO | 2007/001452 | 1/2007 |

OTHER PUBLICATIONS

Cheng, Y., "Mean Shift, Mode Seeking, and Clustering," IEEE Transactions on Pattern Analysis and Machine Intelligence, vol. 17, No. 8, 1995, pp. 790-799.

Cohen, I., "Noise Spectrum Estimation in Adverse Environment: Improved Minima Controlled Recursive Averaging," IEEE Transactions On Speech and Audio Processing, vol. 11, No. 5, 2003, pp. 466-475.

Cohen, I., et al., "Spectral Enhancement by Tracking Speech Presence Probability in Subbands," Proc. International Workshop in Hand-Free Speech Communication (HSC'01), 2001, pp. 95-98.

Coifman, R.R., et al., "Diffusion maps," Applied and Computational Harmonic Analysis, vol. 21, 2006, pp. 5-30.

Hayes, M.H., "Statistical Digital Signal Processing and Modeling," J. Wiley & Sons, Inc., New York, 1996, 200 pages.

Hermansky, H., "Perceptual linear predictive (PLP) analysis of speech," Journal of the Acoustical Society of America, vol. 87, No. 4, 1990, pp. 1738-1752.

Lailler, C., et al., "Semi-Supervised and Unsupervised Data Extraction Targeting Speakers: From Speaker Roles to Fame?," Proceedings of the First Workshop on Speech, Language and Audio in Multimedia (SLAM), Marseille, France, 2013, 6 pages.

Mermelstein, P., "Distance Measures for Speech Recognition—Psychological and Instrumental," Pattern Recognition and Artificial Intelligence, 1976, pp. 374-388.

Schmalenstroeer, J., et al., "Online Diarization of Streaming Audio-Visual Data for Smart Environments," IEEE Journal of Selected Topics in Signal Processing, vol. 4, No. 5, 2010, 12 pages.

Viterbi, A.J., "Error Bounds for Convolutional Codes and an Asymptotically Optimum Decoding Algorithm," IEEE Transactions on Information Theory, vol. 13, No. 2, 1967, pp. 260-269.

* cited by examiner

VOICE ACTIVITY DETECTION USING A SOFT DECISION MECHANISM

CROSS REFERENCE TO RELATED APPLICATIONS

This application is a continuation of U.S. patent application Ser. No. 14/449,770, filed on Aug. 1, 2014, which claims the benefit of U.S. Provisional Application No. 61/861,178, filed Aug. 1, 2013. The contents of these applications are hereby incorporated by reference in their entirety.

BACKGROUND

Voice activity detection (VAD), also known as speech activity detection or speech detection, is a technique used in speech processing in which the presence or absence of human speech is detected. The main uses of VAD are in speech coding and speech recognition. VAD can facilitate speech processing, and can also be used to deactivate some processes during identified non-speech sections of an audio session. Such deactivation can avoid unnecessary coding/transmission of silence packets in Voice over Internet Protocol (VOIP) applications, saving on computation and on network bandwidth.

SUMMARY

Voice activity detection (VAD) is an enabling technology for a variety of speech-based applications. Herein disclosed is a robust VAD algorithm that is also language independent. Rather than classifying short segments of the audio as either "speech" or "silence", the VAD as disclosed herein employees a soft-decision mechanism. The VAD outputs a speech-presence probability, which is based on a variety of characteristics.

In one aspect of the present application, a method of detection of voice activity in audio data, the method comprises obtaining audio data, segmenting the audio data into a plurality of frames, computing an activity probability for each frame from the plurality of features of each frame, compare a moving average of activity probabilities to at least one threshold, and identifying a speech and non-speech segments in the audio data based upon the comparison.

In another aspect of the present application, a method of detection of voice activity in audio data, the method comprises obtaining a set of segmented audio data, wherein the segmented audio data is segmented into a plurality of frames, calculating a smoothed energy value for each of the plurality of frames, obtaining an initial estimation of a speech presence in a current frame of the plurality of frames, updating an estimation of a background energy for the current frame of the plurality of frames, estimating a speech present probability for the current frame of the plurality of frames, incrementing a sub-interval index .mu. modulo U of the current frame of the plurality of frames, and resetting a value of a set of minimum tracers.

In another aspect of the present application, a non-transitory computer readable medium having computer executable instructions for performing a method comprises obtaining audio data, segmenting the audio data into a plurality of frames, computing an activity probability for each frame from the plurality of features of each frame, compare a moving average of activity probabilities to at least one threshold, and identifying a speech and non-speech segments in the audio data based upon the comparison.

In another aspect of the present application, a non-transitory computer readable medium having computer executable instructions for performing a method comprises obtaining a set of segmented audio data, wherein the segmented audio data is segmented into a plurality of frames, calculating a smoothed energy value for each of the plurality of frames, obtaining an initial estimation of a speech presence in a current frame of the plurality of frames, updating an estimation of a background energy for the current frame of the plurality of frames, estimating a speech present probability for the current frame of the plurality of frames, incrementing a sub-interval index .mu. modulo U of the current frame of the plurality of frames, and resetting a value of a set of minimum tracers.

In another aspect of the present application, a method of detection of voice activity in audio data, the method comprises obtaining audio data, segmenting the audio data into a plurality of frames, calculating an overall energy speech probability for each of the plurality of frames, calculating a band energy speech probability for each of the plurality of frames, calculating a spectral peakiness speech probability for each of the plurality of frames, calculating a residual energy speech probability for each of the plurality of frames, computing an activity probability for each of the plurality of frame from the overall energy speech probability, band energy speech probability, spectral peakiness speech probability, and residual energy speech probability, comparing a moving average of activity probabilities to at least one threshold, and identifying a speech and non-speech segments in the audio data based upon the comparison.

DETAILED DISCLOSURE

Figure 1:
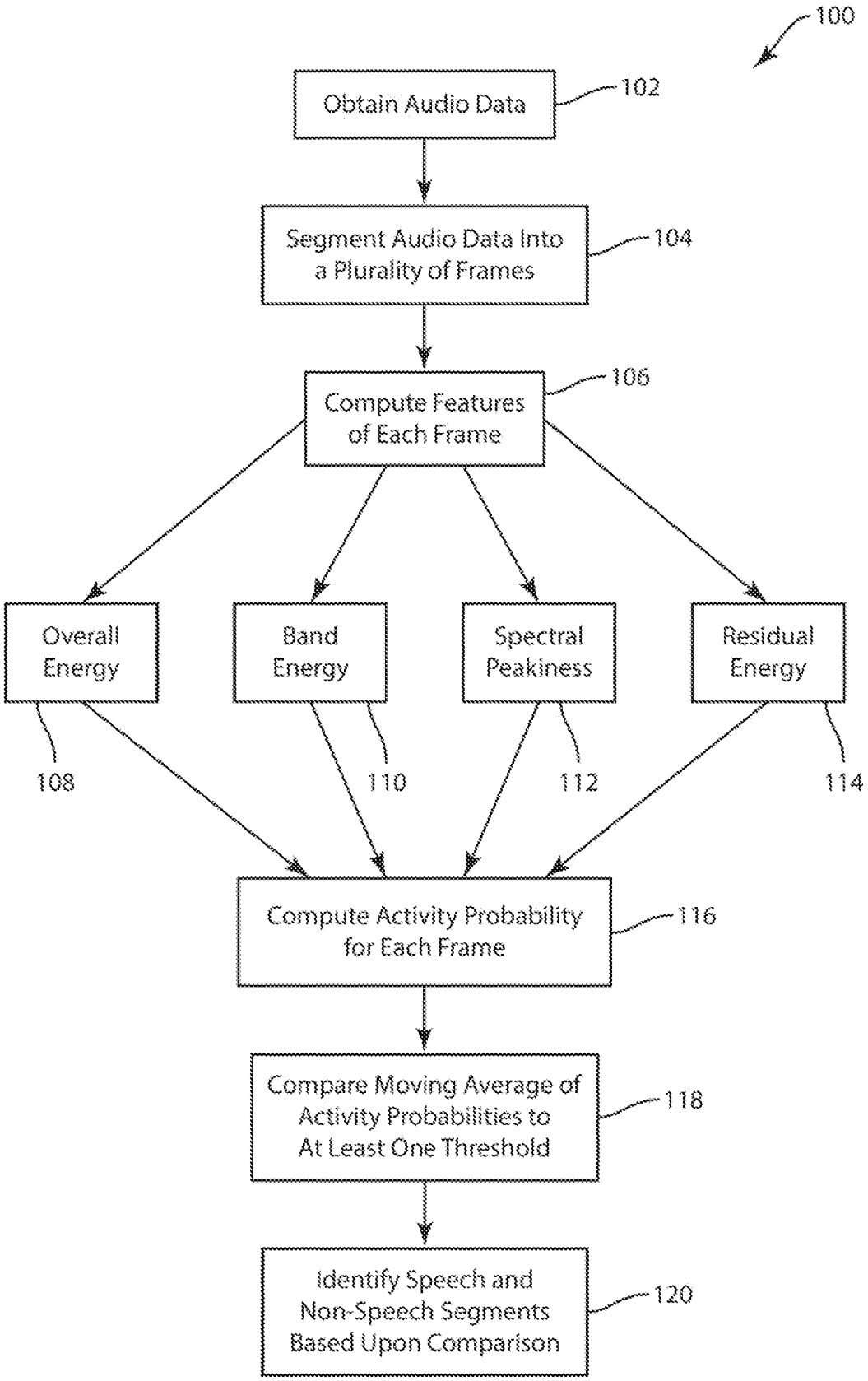
FIG. 1 is a flowchart that depicts an exemplary embodiment of a method of voice activity detection.

Most speech-processing systems segment the audio into a sequence of overlapping frames. In a typical system, a 20-25 millisecond frame is processed every 10 milliseconds. Such speech frames are long enough to perform meaningful spectral analysis and capture the temporal acoustic characteristics of the speech signal, yet they are short enough to give fine granularity of the output.

Having segmented the input signal into frames, features, as will be described in further detail herein, are identified within each frame and each frame is classified as silence/speech. In another embodiment, the speech-presence probability is evaluated for each individual frame. A sequence of frames that are classified as speech frames (e.g. frames having a high speech-presence probability) are identified in order to mark the beginning of a speech segment. Alternatively, a sequence of frames that are classified as silence frames (e.g. having a low speech-presence probability) are identified in order to mark the end of a speech segment.

As disclosed in further detail herein, energy values over time can be traced and the speech-presence probability estimated for each frame based on these values. Additional information regarding noise spectrum estimation is provided by I. Cohen. Noise spectrum estimation in adverse environment: Improved Minima Controlled Recursive Averaging. IEEE Trans. on Speech and Audio Processing, vol. 11(5), pages 466-475, 2003, which is hereby incorporated by reference in its entirety. In the following description a series of energy values computed from each frame in the processed signal, denoted $E_1$ $E_2$, K, $E_T$ is assumed. All $E_t$ values are measured in dB. Furthermore, for each frame the following parameters are calculated:

$S_t$—the smoothed signal energy (in dB) at time t.

$\tau_t$—the minimal signal energy (in dB) traced at time t.

$\tau_t^{(u)}$—the backup values for the minimum tracer, for $1 \le u \le U$ (U is a parameter).

$P_t$—the speech-presence probability at time t.

$B_t$—the estimated energy of the background signal (in dB) at time t.

The first frame is initialized $S_1$, $\tau_1$, $\tau_1^{(u)}$ (for each $1 \le u \le U$), and $B_1$ is equal to $E_1$ and $P_1=0$. The index u is set to be 1.

For each frame t>1, the method 300 is performed.

At 302 the smoothed energy value is computed and the minimum tracers ($0<\alpha_S<1$ is a parameter) are updated, exemplarily by the following equations:

$$S_t=\alpha_S \cdot S_{t-1}+(1-\alpha_S)\cdot E_t$$

$$\tau_t=\min(\tau_{t-1},S_t)$$

$$\tau_t^{(u)}=\min(\tau_{t-1}^{(u)},S_t)$$

Then at 304, an initial estimation is obtained for the presence of a speech signal on top of the background signal in the current frame. This initial estimation is based upon the difference between the smoothed power and the traced minimum power. The greater the difference between the smoothed power and the traced minimum power, the more probable it is that a speech signal exists. A sigmoid function $$\Sigma(x;\mu,\sigma)=\frac{1}{1+e^{\sigma\cdot(\mu-x)}}$$

can be used, where μ,σ are the sigmoid parameters:

$$q=\Sigma(S_t-\tau_t;\mu,\sigma)$$

Next, at 306, the estimation of the background energy is updated. Note that in the event that q is low (e.g. close to 0), in an embodiment an update rate controlled by the parameter $0<\alpha_B<1$ is obtained. In the event that this probability is high, a previous estimate may be maintained:

$$\beta=\alpha_B+(1-\alpha_B)\cdot\sqrt{q}$$

$$B_t=\beta\cdot E_{t-1}+(1-\beta)\cdot S_t$$

The speech-presence probability is estimated at 308 based on the comparison of the smoothed energy and the estimated background energy (again, μ,σ are the sigmoid parameters and $0<\alpha_P<1$ is a parameter):

$$p=\Sigma(S_t-B_t;\mu,\sigma)$$

$$P_t=\alpha_P\cdot P_{t-1}+(1-\alpha_P)\cdot p$$

In the event that t is divisible by V (V is an integer parameter which determines the length of a sub-interval for minimum tracing), then at 310, the sub-interval index u modulo U (U is the number of sub-intervals) is incremented and the values of the tracers are reset at 312:

$$\tau_t=\min_{1\le v\le U}\{\tau_t^{(v)}\}$$

$$\tau_t^{(u)}=S_t$$

In embodiments, this mechanism enables the detection of changes in the background energy level. If the background energy level increases, (e.g. due to change in the ambient noise), this change can be traced after about U·V frames.

Figure 2:
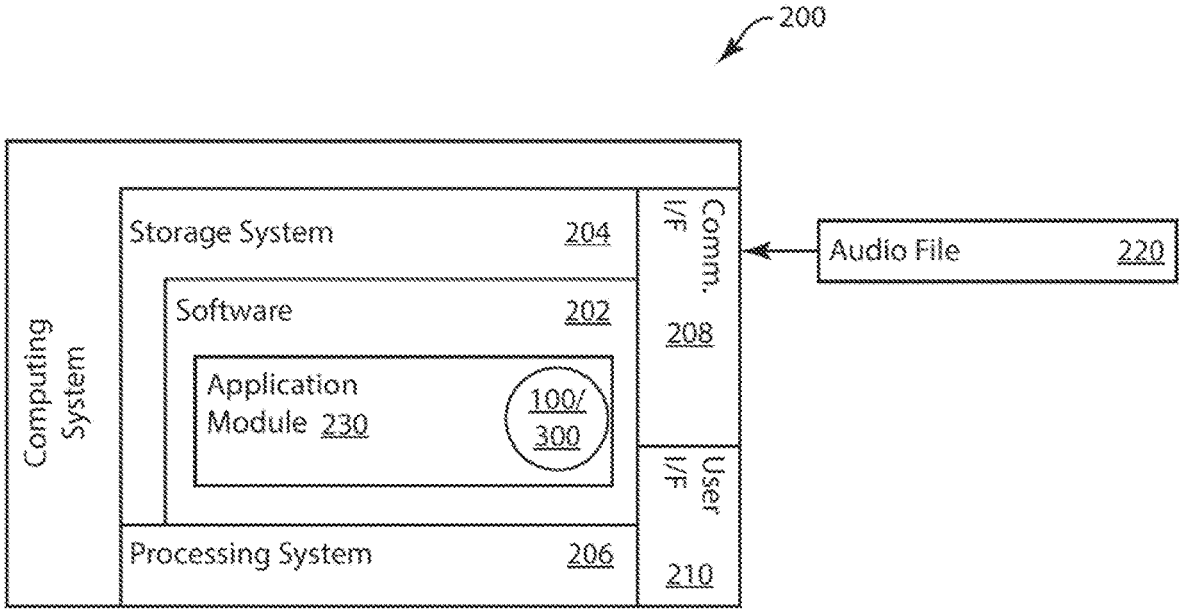
FIG. 2 is a system diagram of an exemplary embodiment of a system for voice activity detection.
Figure 3:
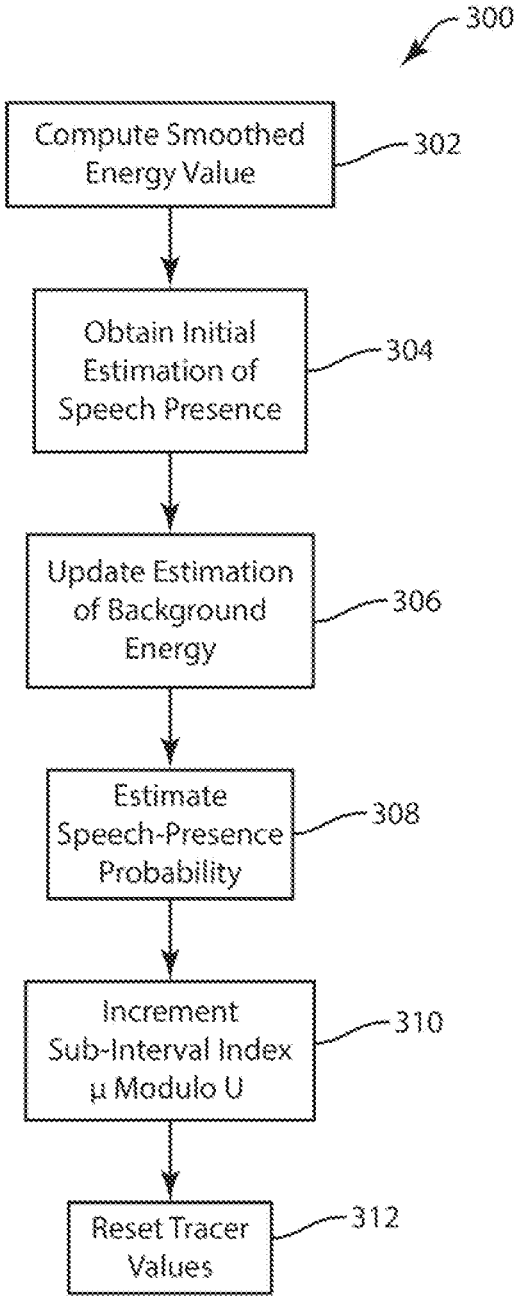
FIG. 3 is a flow chart that depicts an exemplary embodiment of a method of tracing energy values.

FIG. 1 is a flow chart that depicts an exemplary embodiment of a method 100 or method 300 of voice activity detection. FIG. 2 is a system diagram of an exemplary embodiment of a system 200 for voice activity detection. The system 200 is generally a computing system that includes a processing system 206, storage system 204, software 202, communication interface 208 and a user interface 210. The processing system 206 loads and executes software 202 from the storage system 204, including a software module 230. When executed by the computing system 200, software module 230 directs the processing system 206 to operate as described in herein in further detail in accordance with the method 100 of FIG. 1, and the method 300 of FIG. 3.

Although the computing system 200 as depicted in FIG. 2 includes one software module in the present example, it should be understood that one or more modules could provide the same operation. Similarly, while description as provided herein refers to a computing system 200 and a processing system 206, it is to be recognized that implementations of such systems can be performed using one or more processors, which may be communicatively connected, and such implementations are considered to be within the scope of the description.

The processing system 206 can comprise a microprocessor and other circuitry that retrieves and executes software 202 from storage system 204. Processing system 206 can be implemented within a single processing device but can also be distributed across multiple processing devices or sub-systems that cooperate in existing program instructions. Examples of processing system 206 include general purpose central processing units, applications specific processors, and logic devices, as well as any other type of processing device, combinations of processing devices, or variations thereof.

The storage system 204 can comprise any storage media readable by processing system 206, and capable of storing software 202. The storage system 204 can include volatile and non-volatile, removable and non-removable media implemented in any method or technology for storage of information, such as computer readable instructions, data structures, program modules, or other data. Storage system 204 can be implemented as a single storage device but may also be implemented across multiple storage devices or sub-systems. Storage system 204 can further include additional elements, such a controller capable, of communicating with the processing system 206.

Examples of storage media include random access memory, read only memory, magnetic discs, optical discs, flash memory, virtual memory, and non-virtual memory, magnetic sets, magnetic tape, magnetic disc storage or other magnetic storage devices, or any other medium which can be used to storage the desired information and that may be accessed by an instruction execution system, as well as any combination or variation thereof, or any other type of storage medium. In some implementations, the store media can be a non-transitory storage media. In some implementations, at least a portion of the storage media may be transitory. It should be understood that in no case is the storage media a propogated signal.

User interface 210 can include a mouse, a keyboard, a voice input device, a touch input device for receiving a gesture from a user, a motion input device for detecting non-touch gestures and other motions by a user, and other comparable input devices and associated processing elements capable of receiving user input from a user. Output devices such as a video display or graphical display can display an interface further associated with embodiments of the system and method as disclosed herein. Speakers, printers, haptic devices and other types of output devices may also be included in the user interface 210.

As described in further detail herein, the computing system 200 receives a audio file 220. The audio file 220 may be an audio recording or a conversation, which may exemplarily be between two speakers, although the audio recording may be any of a variety of other audio records, including multiples speakers, a single speaker, or an automated or recorded auditory message. The audio file may exemplarily be a .WAV file, but may also be other types of audio files, exemplarily in a post code modulation (PCM) format and an example may include linear pulse code modulated (LPCM) audio filed, or any other type of compressed audio. Furthermore, the audio file is exemplary a mono audio file; however, it is recognized that embodiments of the method as disclosed herein may also be used with stereo audio files. In still further embodiments, the audio file may be streaming audio data received in real time or near-real time by the computing system 200.

In an embodiment, the VAD method 100 of FIG. 1 exemplarily processes frames one at a time. Such an implantation is useful for on-line processing of the audio stream. However, a person of ordinary skill in the art will recognize that embodiments of the method 100 may also be useful for processing recorded audio data in an off-line setting as well.

Referring now to FIG. 1, the VAD method 100 may exemplarily begin at step 102 by obtaining audio data. As explained above, the audio data may be in a variety of stored or streaming formats, including mono audio data. At step 104, the audio data is segmented into a plurality of frames. It is to be understood that in alternative embodiments, the method 100 may alternatively begin receiving audio data already in a segmented format.

Next, at 106, one or more of a plurality of frame features are computed. In embodiments, each of the features are a probability that the frame contains speech, or a speech probability. Given an input frame that comprises samples $x_1$, $x_2$, K, $x_F$ (wherein F is the frame size), one or more, and in an embodiment, all of the following features are computed.

At 108, the overall energy speech probability of the frame is computed. Exemplarily the overall energy of the frame is computed by the equation:

$$\overline{E} = 10 \cdot \log_{10}\left(\sum_{k=1}^{F} (x_k)^2\right)$$

As explained above with respect to FIG. 3, the series of energy levels can be traced. The overall energy speech probability for the current frame, denoted as $p_E$ can be obtained and smoothed given a parameter $0<\alpha<1$:

$$\tilde{p}_E = \alpha \cdot \tilde{p}_E + (1-\alpha) \cdot p_E$$

Next, at step 110, a band energy speech probability is computed. This is performed by first computing the temporal spectrum of the frame (e.g. by concatenating the frame to the tail of the previous frame, multiplying the concatenated frames by a Hamming window, and applying Fourier transform of order N). Let $X_0$, $X_1$, K, $X_{N/2}$ be the spectral coefficients. The temporal spectrum is then subdivided into bands specified by a set of filters $H_0^{(b)}$, $H_1^{(b)}$, K, $H_{N/2}^{(b)}$ for $1 \le b \le M$ (wherein M is the number of bands; the spectral filters may be triangular and centered around various frequencies such that $\Sigma_k H_k^{(b)}=1$). Further detail of one embodiment is exemplarily provided by I. Cohen, and B. Berdugo. *Spectral enhancement by tracking speech presence probability in subbands*. Proc. International Workshop on Hand-free Speech Communication (HSC'01), pages 95-98, 2001, which is hereby incorporated by reference in its entirety. The energy level for each band is exemplarily computed using the equation:

$$E^{(b)} = 10 \cdot \log_{10}\left(\sum_{k=0}^{\frac{N}{2}} H_k^{(b)} \cdot |X_k|^2\right)$$

The series of energy levels for each band is traced, as explained above with respect to FIG. 3. The band energy speech probability $P_B$ for each band in the current frame, which we denote $p^{(b)}$ is obtained, resulting in:

$$p_B = \frac{1}{M} \cdot \sum_{b=1}^{M} p^{(b)}$$

At 112, a spectral peakiness speech probability is computed A spectral peakiness ratio is defined as:

$$\rho = \frac{\sum_{k:\ |X_k|>|X_{k-1}|,|X_{k+1}|} |X_k|^2}{\sum_{k=0}^{\frac{N}{2}} |X_k|^2}$$

The spectral peakiness ratio measures how much energy in concentrated in the spectral peaks. Most speech segments are characterized by vocal harmonies, therefore this ratio is expected to be high during speech segments. The spectral peakiness ratio can be used to disambiguate between vocal segments and segments that contain background noises. The spectral peakiness speech probability $p_P$ for the frame is obtained by normalizing $\rho$ by a maximal value $\rho_{max}$ (which is a parameter), exemplarily in the following equations:

$$p_P = \frac{\rho}{\rho_{max}}$$

$$\tilde{p}_P = \alpha \cdot \tilde{p}_P + (1-\alpha) \cdot p_P$$

At step 114, the residual energy speech probability for each frame is calculated. To calculate the residual energy, first a linear prediction analysis is performed on the frame. In the linear prediction analysis given the samples $x_1$, $x_2$, K, $x_F$ a set of linear coefficients $a_1$, $a_2$, K, $a_L$ (L is the linear-prediction order) is computed, such that the following expression, known as the linear-prediction error, is brought to a minimum:

$$\varepsilon = \sum_{k=1}^{F}\left(x_k - \sum_{i=1}^{L} a_i \cdot x_{k-i}\right)^2$$

The linear coefficients may exemplarily be computed using a process known as the Levinson-Durbin algorithm which is described in further detail in M. H. Hayes. Statistical Digital Signal Processing and Modeling. J. Wiley & Sons Inc., New York, 1996, which is hereby incorporated by reference in its entirety. The linear-prediction error (relative to overall the frame energy) is high for noises such as ticks or clicks, while in speech segments (and also for regular ambient noise) the linear-prediction error is expected to be low. We therefore define the residual energy speech probability ($P_R$) as:

$$p_R = \left(1 - \frac{\varepsilon}{\sum_{k=1}^{F}(x_k)^2}\right)^2$$

$$\tilde{p}_R = \alpha \cdot \tilde{p}_R + (1-\alpha) \cdot p_R$$

After one or more of the features highlighted above are calculated, an activity probability Q for each frame cab be calculated at 116 as a combination of the speech probabilities for the Band energy ($P_B$), Total energy ($P_E$), Energy Peakiness ($P_P$), and Residual Energy ($P_R$) computed as described above for each frame. The activity probability (Q) is exemplarily given by the equation:

$$Q = \sqrt{p_B \cdot \max\{\tilde{p}_E, \tilde{p}_P, \tilde{p}_R\}}$$

It should be noted that there are other methods of fusing the multiple probability values (four in our example, namely $p_B$, $p_E$, and $p_R$) into a single value Q. The given formula is only one of many alternative formulae. In another embodiment, Q may be obtained by feeding the probability values to a decision tree or an artificial neural network.

After the activity probability (Q) is calculated for each frame at 116, the activity probabilities ($Q_t$) can be used to detect the start and end of speech in audio data. Exemplarily, a sequence of activity probabilities are denoted by $Q_1$, $Q_2$, K, $Q_T$. For each frame, let $\hat{Q}_t$ be the average of the probability values over the last L frames:

$$\hat{Q}_t = \frac{1}{L} \cdot \sum_{k=0}^{L-1} Q_{t-k}$$

The detection of speech or non-speech segments is carried out with a comparison at 118 of the average activity probability $\hat{Q}_t$ to at least one threshold (e.g. $Q_{max}$, $Q_{min}$). The detection of speech or non-speech segments co-believed as a state machine with two states, "non-speech" and "speech":

Start from the "non-speech" state and t=1

Given the tth frame, compute $Q_t$ and the update $\hat{Q}_t$

Act according to the current state

If the current state is "no speech":

Check if $\hat{Q}_t > Q_{max}$. If so, mark the beginning of a speech segment at time (t−k), and move to the "speech" state.

If the current state is "speech":

Check if $\hat{Q}_t < Q_{min}$. If so, mark the end of a speech segment at time (t−k), and move to the "no speech" state.

Increment t and return to step 2.

Thus, at 120 the identification of speech or non-speech segments is based upon the above comparison of the moving average of the activity probabilities to at least one threshold. In an embodiment, $Q_{max}$ therefore represents an maximum activity probability to remain in a non-speech state, while $Q_{min}$ represents a minimum activity probability to remain in the speech state.

In an embodiment, the detection process is more robust then previous VAD methods, as the detection process requires a sufficient accumulation of activity probabilities over several frames to detect start-of-speech, or conversely, to have enough contiguous frames with low activity probability to detect end-of-speech.

Traditional VAD methods are based on frame energy, or on band energies. In the suggested methods, the system and method of the present application also takes into consideration additional features such as residual LP energy and spectral peakiness. In other embodiments, additional features may be used, which help distinguish speech from noise, where noise segments are also characterized by high energy values:

Spectral peakiness values are high in the presence of harmonics, which are characteristic to speech (or music). Car noises and bubble noises, for example, are not harmonic and therefore have low spectral peakiness; and High residual LP energy is characteristic for transient noises, such as clicks, bangs, etc.

The system and method of the present application uses a soft-decision mechanism and assigns a probability with each frame, rather than classifying it as either 0 (non-speech) or 1 (speech):

obtains a more reliable estimation of the background energies; and

It is less dependent on a single threshold for the classification of speech/non-speech, which leads to false recognition of non-speech segments if the threshold is too low, or false rejection of speech segments if it is too high. Here, two thresholds are used (Q.sub.min and Q.sub.max in the application), allowing for some uncertainty. The moving average of the Q values make the system and method switch from speech to non-speech (or vice versa) only when the system and method are confident enough.

The functional block diagrams, operational sequences, and flow diagrams provided in the Figures are representative of exemplary architectures, environments, and methodologies for performing novel aspects of the disclosure. While, for purposes of simplicity of explanation, the methodologies included herein may be in the form of a functional diagram, operational sequence, or flow diagram, and may be described as a series of acts, it is to be understood and appreciated that the methodologies are not limited by the order of acts, as some acts may, in accordance therewith, occur in a different order and/or concurrently with other acts from that shown and described herein. For example, those skilled in the art will understand and appreciate that a methodology can alternatively be represented as a series of interrelated states or events, such as in a state diagram. Moreover, not all acts illustrated in a methodology may be required for a novel implementation.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A method for identifying non-speech segments in audio data to avoid processing the non-speech segments, the method comprising:

obtaining audio data;

segmenting the audio data into a sequence of frames;

calculating an activity probability for each frame in the sequence, wherein the activity probability corresponds to a probability that the frame contains speech;

determining, frame-by-frame, a state of each frame in the sequence as either speech or non-speech by comparing a moving average of activity probabilities for a group of frames, including the frame, to a selected threshold, wherein the selected threshold for a particular frame depends on the determined state of a frame proceeding the particular frame in the sequence;

identifying non-speech segments in the audio data based upon the determined states of the frames; and deactivating subsequent processing of the non-speech segments in the audio data;

wherein the selected threshold for a frame following a non-speech frame is a maximum activity probability, which the moving average must exceed for the state of the frame to be determined as speech.

2. The method according to claim 1, wherein each non-speech segment corresponds to audio data in one or more consecutive non-speech frames bordered in the sequence by speech frames.

3. The method according to claim 1, further comprising:

identifying speech segments in the audio data based upon the determined states of the frames; and activating subsequent processing of the speech segments in the audio data.

4. The method according to claim 3, wherein each speech segment corresponds to audio data in one or more consecutive speech frames bordered in the sequence by non-speech frames.

5. A method for identifying non-speech segments in audio data to avoid processing the non-speech segments, the method comprising:

obtaining audio data;

segmenting the audio data into a sequence of frames;

calculating an activity probability for each frame in the sequence, wherein the activity probability corresponds to a probability that the frame contains speech;

determining, frame-by-frame, a state of each frame in the sequence as either speech or non-speech by comparing a moving average of activity probabilities for a group of frames, including the frame, to a selected threshold, wherein the selected threshold for a particular frame depends on the determined state of a frame proceeding the particular frame in the sequence;

identifying non-speech segments in the audio data based upon the determined states of the frames; and deactivating subsequent processing of the non-speech segments in the audio data wherein the selected threshold for a frame following a speech frame is a minimum activity probability, which the moving average must be below for the state of the frame to be determined as non-speech.

6. The method according to claim 5, wherein each non-speech segment corresponds to audio data in one or more consecutive non-speech frames bordered in the sequence by speech frames.

7. The method according to claim 5, further comprising:

identifying speech segments in the audio data based upon the determined states of the frames; and activating subsequent processing of the speech segments in the audio data.

8. The method according to claim 7, wherein each speech segment corresponds to audio data in one or more consecutive speech frames bordered in the sequence by non-speech frames.

9. A method for identifying non-speech segments in audio data to avoid processing the non-speech segments, the method comprising:

obtaining audio data;

segmenting the audio data into a sequence of frames;

calculating an activity probability for each frame in the sequence, wherein the activity probability corresponds to a probability that the frame contains speech;

determining, frame-by-frame, a state of each frame in the sequence as either speech or non-speech by comparing a moving average of activity probabilities for a group of frames, including the frame, to a selected threshold, wherein the selected threshold for a particular frame depends on the determined state of a frame proceeding the particular frame in the sequence;

identifying non-speech segments in the audio data based upon the determined states of the frames; and deactivating subsequent processing of the non-speech segments in the audio data wherein the activity probability for a frame is a combination of a plurality of different speech probabilities computed using the audio data of the frame wherein the plurality of different speech probabilities comprises:

an overall energy speech probability based on an overall the energy of the audio data;

a band energy speech probability based on an energy of the audio data contained within one or more spectral bands;

a spectral peakiness speech probability based on an energy of the audio data that is concentrated in one or more spectral peaks; and a residual energy speech probability based on a residual energy resulting from a linear prediction of the audio data.

10. The method according to claim 9, wherein the overall energy speech probability, the band energy speech probability, the spectral peakiness probability and the residual energy speech probability each have a value between 0 and 1, wherein 0 corresponds to non-speech and 1 corresponds to speech.

11. The method according to claim 10, wherein the activity probability is the square root of the band energy speech probability multiplied by the largest of the overall energy probability, the spectral peakiness probability, and the residual energy probability.

12. A non-transitory computer readable medium containing computer readable instructions that when executed by a processor of a computing device cause the computing device to perform a method for identifying non-speech segments in audio data to avoid processing the non-speech segments, the method comprising:

obtaining audio data;

segmenting the audio data into a sequence of frames;

calculating an activity probability for each frame in the sequence, wherein the activity probability corresponds to a probability that the frame contains speech;

determining, frame-by-frame, a state of each frame in the sequence as either speech or non-speech by comparing a moving average of activity probabilities for a group of frames, including the frame, to a selected threshold, wherein the selected threshold for a particular frame depends on the determined state of a frame proceeding the particular frame in the sequence;

identifying non-speech segments in the audio data based upon the determined states of the frames; and deactivating subsequent processing of the non-speech segments in the audio data;

wherein the selected threshold for a frame following a non-speech frame is a maximum activity probability, which the moving average must exceed for the state of the frame to be determined as speech.

13. The non-transitory computer readable medium according to claim 12, wherein each non-speech segment corresponds to audio data in one or more consecutive non-speech frames bordered in the sequence by speech frames.

14. The non-transitory computer readable medium according to claim 12, further comprising:

identifying speech segments in the audio data based upon the determined states of the frames; and activating subsequent processing of the speech segments in the audio data.

15. The non-transitory computer readable medium according to claim 14, wherein each speech segment corresponds to audio data in one or more consecutive speech frames bordered in the sequence by non-speech frames.

16. A non-transitory computer readable medium containing computer readable instructions that when executed by a processor of a computing device cause the computing device to perform a method for identifying non-speech segments in audio data to avoid processing the non-speech segments, the method comprising:

obtaining audio data;

segmenting the audio data into a sequence of frames;

calculating an activity probability for each frame in the sequence, wherein the activity probability corresponds to a probability that the frame contains speech;

determining, frame-by-frame, a state of each frame in the sequence as either speech or non-speech by comparing a moving average of activity probabilities for a group of frames, including the frame, to a selected threshold, wherein the selected threshold for a particular frame depends on the determined state of a frame proceeding the particular frame in the sequence;

identifying non-speech segments in the audio data based upon the determined states of the frames; and deactivating subsequent processing of the non-speech segments in the audio data;

wherein the selected threshold for a frame following a speech frame is a minimum activity probability, which the moving average must be below for the state of the frame to be determined as non-speech.

17. The non-transitory computer readable medium according to claim 16, wherein each non-speech segment corresponds to audio data in one or more consecutive non-speech frames bordered in the sequence by speech frames.

18. The non-transitory computer readable medium according to claim 16, further comprising:

identifying speech segments in the audio data based upon the determined states of the frames; and activating subsequent processing of the speech segments in the audio data.

19. The non-transitory computer readable medium according to claim 18, wherein each speech segment corresponds to audio data in one or more consecutive speech frames bordered in the sequence by non-speech frames.

20. A non-transitory computer readable medium containing computer readable instructions that when executed by a processor of a computing device cause the computing device to perform a method for identifying non-speech segments in audio data to avoid processing the non-speech segments, the method comprising:

obtaining audio data;

segmenting the audio data into a sequence of frames;

calculating an activity probability for each frame in the sequence, wherein the activity probability corresponds to a probability that the frame contains speech;

determining, frame-by-frame, a state of each frame in the sequence as either speech or non-speech by comparing a moving average of activity probabilities for a group of frames, including the frame, to a selected threshold, wherein the selected threshold for a particular frame depends on the determined state of a frame proceeding the particular frame in the sequence;

identifying non-speech segments in the audio data based upon the determined states of the frames; and deactivating subsequent processing of the non-speech segments in the audio data;

wherein the activity probability for a frame is a combination of a plurality of different speech probabilities computed using the audio data of the frame and wherein the plurality of different speech probabilities comprises:

an overall energy speech probability based on an overall the energy of the audio data;

a band energy speech probability based on an energy of the audio data contained within one or more spectral bands;

a spectral peakiness speech probability based on an energy of the audio data that is concentrated in one or more spectral peaks; and a residual energy speech probability based on a residual energy resulting from a linear prediction of the audio data.

21. The non-transitory computer readable medium according to claim 20, wherein the overall energy speech probability, the band energy speech probability, the spectral peakiness probability and the residual energy speech probability each have a value between 0 and 1, wherein 0 corresponds to non-speech and 1 corresponds to speech.

22. The non-transitory computer readable medium according to claim 21, wherein the activity probability is the square root of the band energy speech probability multiplied by the largest of the overall energy probability, the spectral peakiness probability, and the residual energy probability.

* * * * *